US006572365B1

(12) United States Patent
Byxbe

(10) Patent No.: US 6,572,365 B1
(45) Date of Patent: Jun. 3, 2003

(54) AUTOMATIC CANDLE SNUFFER

(76) Inventor: Justin Byxbe, 1339 Laburnum Ave., Chico, CA (US) 95926

( * ) Notice: Subject to any disclaimer, the term of this patent is extended or adjusted under 35 U.S.C. 154(b) by 0 days.

(21) Appl. No.: 10/107,637

(22) Filed: Mar. 26, 2002

(51) Int. Cl.[7] ..... F23Q 25/00; F21V 35/00; F21V 25/00

(52) U.S. Cl. ..... 431/33; 431/291; 431/289

(58) Field of Search ..... 431/33, 34, 35, 431/86, 88, 144–152, 291; 215/235, 236, 237; 232/44; 292/251.5; 126/25 C; 49/29, 30, 70

(56) References Cited

U.S. PATENT DOCUMENTS

| | | | | | |
|---|---|---|---|---|---|
| 147,204 | A | * | 2/1874 | Walton | 362/162 |
| 313,297 | A | * | 3/1885 | Bunnell | 431/86 |
| 578,282 | A | * | 3/1897 | Bigby | 362/180 |
| 736,538 | A | * | 8/1903 | Newsom | 431/33 |
| 897,712 | A | * | 9/1908 | Brusseau | 431/33 |
| 1,152,412 | A | * | 9/1915 | Hanaoka | 431/87 |
| 2,259,416 | A | * | 10/1941 | Gardener | 362/187 |
| 2,316,812 | A | * | 4/1943 | Russell | 200/52 R |
| 3,905,746 | A | * | 9/1975 | Patrikios | 431/145 |
| 3,911,680 | A | * | 10/1975 | Blanchard | 446/210 |
| 5,511,682 | A | * | 4/1996 | Pace | 220/230 |
| 5,860,725 | A | * | 1/1999 | Zer et al. | 362/161 |
| 6,050,808 | A | * | 4/2000 | Schloss | 126/39 E |

FOREIGN PATENT DOCUMENTS

| | | | |
|---|---|---|---|
| GB | 142463 | * | 2/1976 |
| JP | 54-67237 | * | 5/1979 |
| JP | 54-72528 | * | 6/1979 |
| JP | 58-153020 | * | 9/1983 |
| JP | 60-188734 | * | 9/1985 |
| JP | 03-8208 | * | 1/1991 |
| JP | 09-63352 | * | 3/1997 |

* cited by examiner

*Primary Examiner*—Carl D. Price
(74) *Attorney, Agent, or Firm*—Michael I. Kroll

(57) ABSTRACT

An automatic candle snuffer has a heat resistant housing with a bottom end that is received and closed by a candle holder. The housing top end is open when a hinged lid is open and closed when the lid is closed. A digital timer is attached to the housing and has a fixed part of the hinge attached for selectively magnetizing and demagnetizing. The hinge also has a magnetic portion attached to the lid, such that the lid is held open by the magnetic coupling of the fixed part of the hinge and the magnetic hinge portion attached to the lid. The user selects a time for the candle to be snuffed, and the timer demagnetizes the fixed part of the hinge, whereupon the magnetic coupling is broken and gravity causes the lid to close on the housing.

25 Claims, 11 Drawing Sheets

AUTOMATIC CANDLE SNUFFER

BACKGROUND OF THE INVENTION

1. Field of the Invention

The present invention relates generally to candle extinguishing devices and more specifically to an automatic candle extinguishing device.

2. Description of the Prior Art

There are other automatic candle snuffing devices designed to snuff out a candle flame. Typical of these is U.S. Pat. No. 211,902 issued to Frazee et al. on Feb. 4, 1879.

Another patent was issued to Pinel on Feb. 17, 1885 as U.S. Pat. No. 312,291. Yet another U.S. Pat. No. 434,297 was issued to Roell on Aug. 12, 1890 and still yet another was issued on Oct. 30, 1900 to Hagen as U.S. Pat. No. 660,899.

Another patent was issued to Stevenson on June 28, 1904 as U.S. Pat. No. 763,440. Another patent was issued to Kaiserreiner on Jan. 29, 1907 as U.S. Pat. No. 842,463. Another patent was issued to Findlay on Apr. 28, 1908 as U.S. Pat. No. 886,198. Another patent was issued to Baird on July 3, 1919 as U.S. Pat. No. 1,308,215. Another patent was issued to McHollan on Jul. 13, 1948 as U.S. Pat. No. 2,528,604. Another patent was issued to Ronnback on Apr. 4, 1989 as U.S. Pat. No. 4,818,214. Another patent was issued to Kroecher on Aug. 31, 1999 as U.S. Pat. No. 5,944,505.

The international application of Theodorus et al. was published under the Patent Cooperation Treaty on Dec. 14, 2000, as International Publication Number WO 00/75562 A1.

The invention relates to an improvement in automatic lamp extinguishers. The object being to provide a lamp with attachments arranged and constructed in such a manner that they may be adjusted to automatically extinguish the flame of the lamp at any predetermined time. The device uses a floating mechanism that descends as the lamp oil is burned.

A new and useful improvement in apparatus for automatically extinguishing candles using a wire ring mechanism.

A new and useful improvement in apparatus for automatically extinguishing candles consisting in combination with a candle shade support, a small ring, fork, triangle, and two parallel bars.

A new and useful improvement in apparatus for automatically extinguishing candles, consisting of a candle holder of any approved construction and adapted to be attached to the limb of a Christmas tree on which it will be used.

The invention relates to the class of candle extinguishers that can be adjusted to extinguish the candle after a predetermined amount has been consumed. An alarm bell is attached to the extinguisher so that it may be sounded a few minutes before the extinguisher can operate to enable the user to adjust it.

The device consists in substance, of a ring and flap tongues, which are hinged to the ring and are under action of a spring which acts to press the flap tongues inwardly. The circumference of the ring is preferably flat sided, the flap tongues thus constituting upward continuations of the individual sides of the ring.

The device of the invention is designed for use by readers in bed so as to obviate any danger of fire by reason of the candle burning down after the reader has fallen asleep, and the appliance in its construction provides means whereby the candle upon being burned to its given limit thereby releases mechanism and so allows the cap to fall on to and extinguish the lighted candle.

The invention relates to the class of candle extinguishers which can be adjusted to extinguish the candle after a predetermined amount has been consumed. A pivoting cap mechanism is utilized.

This invention relates to a candle shaped supporter. The object of the invention is to provide a candle shade supporter that is applied to a candle and so that the location of the shade on the candle may be readily adjusted, and one which may or may not have incorporated in it, novel automatic candle extinguishing means which will extinguish the candle flame when the candle has burned down to the top of the supporter.

A burning candle is provided with a sleeve of heat-shrinkable plastics. When affected by the heat generated by the flame of the lit candle the sleeve shrinks and at least partly closes about the end of the candle, thus extinguishing the candle flame.

A candle holder has candles mounted at each end of a pivoting balance arm. A snuffer is located above each candle. When the balance arm is balanced and one of the candles is lit then the lit candle will become lighter as fuel is consumed by combustion at its wick. When this happens the balance arm pivots so that the end of the balance arm bearing the lit candle rises. This continues until the lit candle is raised to a location at which it is extinguished by one of the snuffers. After the candle has been extinguished then the second candle may be lit. The candle holder prevents candles from continuing to bum for extended periods of time. The candle holder is interesting to watch in operation.

The invention is related to a candle holder for various candle diameters, whereby the candle is clamped between at least two clamping r surfaces or clamping edges which are movable in respect to each other and are in general moved towards each other by means of a spring. In case of the known candle holders the candle is extinguished when the melting zone of the burning candle approaches or reaches the clamping surfaces. The characteristic of the candle holder is that there is under the clamping surfaces a candle chamber which has an opening at the upper side, which opening is partly or completely closed when the clamping surfaces move towards each other.

While these devices may be suitable for the purposes for which they were designed, they would not be as suitable for the purposes of the present invention, as hereinafter described. In particular, none of these devices provide an electronically regulated and precisely timed flame extermination capability.

What is needed is a device that will allow a candle to burn for any length of time followed by an extermination of the flame at a time specifically chosen by the user.

SUMMARY OF THE PRESENT INVENTION

A primary object of the present invention is to provide an automatic candle extinguishing device.

Another object of the present invention is to provide a candle extinguishing device having a digital timer.

Yet another object of the present invention is to provide a candle extinguishing device having a digital timer that controls the closing of the lid of a housing that encompasses or holds the candle.

Still yet another object of the present invention is to provide a candle extinguishing device having a magnetic element fixed to the lid that when the timer's set time has expired, the timer shuts off and the lid is released, snuffing out the candle flame.

Additional objects of the present invention will appear as the description proceeds.

The present invention overcomes the shortcomings of the prior art by providing an automatic candle extinguishing device consisting of a heat resistant glass tube housing with a digital timer device and lid with a magnetic element that magnetically couples with a selectively magnetized member. When magnetically decoupled the lid is pulled by gravity to a down position closing off the housing. The candle will be extinguished when the flame has used the remainder of the oxygen within the closed candle housing.

To reset the timer, the lid is manually opened, and the timer is set to desired time. The device of the present invention may be used in conjunction with a standard candle stick holder or may be provided with its own fitted candle stick holding device.

A device is provided for extinguishing the flame of a candle in a candle holder, comprising: a housing portion having a top end, a bottom end, a top opening, and a bottom opening, the bottom end being adapted for receipt by the candle holder, such that the housing is supported by the candle holder and air flow through the bottom opening is substantially eliminated; a timer having a magnetized portion, the timer being programmed and configured such that the timer's magnetized portion is demagnetized at a time set on the timer, the timer being settable for subsequent remagnetization; and a lid, the lid being hinged to the housing, the lid being sized to substantially eliminate airflow into the top opening when the lid is on the top opening, the lid having a magnetic portion, the lid and the timer being positioned such that the timer's magnetized portion is magnetically coupled to the lid's magnetic portion when the lid is open, the lid being further positioned such that the lid is closed by gravity on to the housing top end when the magnetic coupling with the timer is terminated, the air in the housing subsequently being insufficient to sustain the candle flame.

In one embodiment, a device is provided for extinguishing the flame of a candle, comprising: a housing portion having a top end, a closed bottom end, and a top opening, the bottom end being adapted to receive and support the candle; a timer having a magnetized portion, the timer being programmed and configured such that the timer's magnetized portion is demagnetized at a time set on the timer, the timer being settable for subsequent remagnetization; and a lid, the lid being hinged to the housing, the lid being sized to substantially eliminate airflow into the top opening when the lid is on the top opening, the lid having a magnetic portion, the lid and the timer being positioned such that the timer's magnetized portion is magnetically coupled to the lid's magnetic portion when the lid is open, the lid being further positioned such that the lid is closed by gravity on to the housing top end when the magnetic coupling with the timer is terminated, the air in the housing subsequently being insufficient to sustain the candle flame.

In another embodiment, the bottom end is adapted for supporting receipt by a candle holder.

In one embodiment, a device is provided for extinguishing the flame of a candle, comprising: a candle holder; a housing portion having a top end, a bottom end, a top opening, and a bottom opening, the bottom end being adapted for receipt by the candle holder, such that the housing is supported by the candle holder and air flow through the bottom opening is substantially eliminated; a timer having a magnetized portion, the timer being programmed and configured such that the timer's magnetized portion is demagnetized at a time set on the timer, the timer being settable for subsequent remagnetization; and a lid, the lid being hinged to the housing, the lid being sized to substantially eliminate airflow into the top opening when the lid is on the top opening, the lid having a magnetic portion, the lid and the timer being positioned such that the timer's magnetized portion is magnetically coupled to the lid's magnetic portion when the lid is open, the lid being further positioned such that the lid is closed by gravity on to the housing top end when the magnetic coupling with the timer is terminated, the air in the housing subsequently being insufficient to sustain the candle flame.

In one embodiment, a device is provided for extinguishing the flame of a candle in a candle holder, comprising: means for housing the candle; means for selectively and alternately magnetizing and demagnetizing a member, said means having means for setting a time certain for demagnetization; and a lid, the lid being pivotable with respect to the housing means, the lid being positioned such that airflow into the housing means is substantially eliminated when the lid is in a down position, the lid having a magnetic portion, the lid being further positioned such that the magnetized member is magnetically coupled to the lid's magnetic portion when the lid is in an up position, the lid being further positioned such that the lid is closed by gravity to the down position when the magnetic coupling is terminated, the air in the housing means subsequently being insufficient to sustain the candle flame.

In one embodiment, a device is provided for extinguishing the flame of a candle in a candle holder, comprising: a housing portion having a top end, a bottom end, a top opening, and a bottom opening, the bottom end being adapted for receipt by the candle holder, such that the housing is supported by the candle holder and air flow through the bottom opening is substantially eliminated; a timer attached to the housing; a lid and a hinge attaching the lid to the timer; the hinge having a first portion attached to and magnetized by the timer, the timer being programmed and configured such that the hinge first portion is demagnetized at a time set on the timer, the timer being settable for subsequent remagnetization of the hinge first portion; the lid being sized to substantially eliminate airflow into the top opening when the lid is on the top opening; the hinge having a magnetic second portion attached to the lid; the lid and the timer being positioned such that the hinge first portion is magnetically coupled to the hinge second portion when the lid is open; and the lid being further positioned such that the lid is closed by gravity on to the housing top end when the magnetic coupling between the hinge first portion and the hinge second portion is terminated, the air in the housing subsequently being insufficient to sustain the candle flame.

In one embodiment, a device is provided for extinguishing the flame of a candle, comprising: a housing portion having a top end, a bottom end, and a top opening, the bottom end being adapted to receive and support the candle; a timer attached to the housing; a lid and a hinge attaching the lid to the timer; the hinge having a first portion attached to and magnetized by the timer, the timer being programmed and configured such that the hinge first portion is demagnetized at a time set on the timer, the timer being settable for subsequent remagnetization of the hinge first portion; the lid being sized to substantially eliminate airflow into the top opening when the lid is on the top opening; the hinge having a magnetic second portion attached to the lid; the lid and the timer being positioned such that the hinge first portion is magnetically coupled to the hinge second portion when the lid is open; and the lid being further positioned such that the lid is closed by gravity on to the housing top end when the magnetic coupling between the hinge first portion and the hinge second portion is terminated, the air in the housing subsequently being insufficient to sustain the candle flame.

In another embodiment, the bottom end is adapted for supporting receipt by a candle holder.

In one embodiment, a device is provided for extinguishing the flame of a candle, comprising: a candle holder; a housing portion having a top end, a bottom end, a top opening, and a bottom opening, the bottom end being adapted for receipt by the candle holder, such that the housing is supported by the candle holder and air flow through the bottom opening is substantially eliminated; a timer attached to the housing; a lid and a hinge attaching the lid to the timer; the hinge having a first portion attached to and magnetized by the timer, the timer being programmed and configured such that the hinge first portion is demagnetized at a time set on the timer, the timer being settable for subsequent remagnetization of the hinge first portion; the lid being sized to substantially eliminate airflow into the top opening when the lid is on the top opening; the hinge having a magnetic second portion attached to the lid; the lid and the timer being positioned such that the hinge first portion is magnetically coupled to the hinge second portion when the lid is open; and the lid being further positioned such that the lid is closed by gravity on to the housing top end when the magnetic coupling between the hinge first portion and the hinge second portion is terminated, the air in the housing subsequently being insufficient to sustain the candle flame.

In the various embodiments, the timer has one or more of several capabilities, such as push button controls on the timer, a timer display, a lighted timer display, a digital timer, a display of the current time, the time of the next demagnetization, and/or the amount of time until the next demagnetization event The foregoing and other objects and advantages will appear from the description to follow. In the description reference is made to the accompanying drawing, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawing, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

FIG. 1 is a perspective view of a typical prior art candle holder. Candles may be used to provide light as well as atmosphere or mood. While it is possible to blow a candle flame out, it is not generally desirable to do so, as it may interrupt a romantic atmosphere and hinder the mood.

FIG. 2 is a perspective view of the present invention in use. The device of the present invention includes a glass housing having a digital timer device attached thereto. While the timer is running it magnetizes a plate on the timer that holds the lid in the open position. When the designated time has expired, the magnetic field is terminated and the lid swings closed, sealing the housing from the oxygen supply.

FIG. 3 is a detail perspective view of the device of the present invention with a lit candle. The device of the present invention may be used in conjunction with a standard candle stick holder. The housing having an automatic digitally controlled timer device fits over a candle stick and may be set for a specific amount of time. After that time has expired, the timer shuts off and gravity shuts the lid, releasing it down over the opening of the tube, blocking the opening and suffocating the flame of the candle.

FIG. 4 is a detail view of the present invention. The glass candle housing is constructed using heat resistant glass that will allow a candle to bum for a given period of time and not crack under intense heat.

FIG. 5 is a detail view of the present invention. The digital timer controls the closing of the lid when the time set has expired. To restart the timer, the lid is manually opened and the digital timer reset to the desired time required by the user.

FIG. 6 is a detail view of the present invention. The digital timer controls the closing of the lid when the time set has expired. To restart the timer, the lid is manually opened and the digital timer reset to the desired time required by the user.

Figure 9:
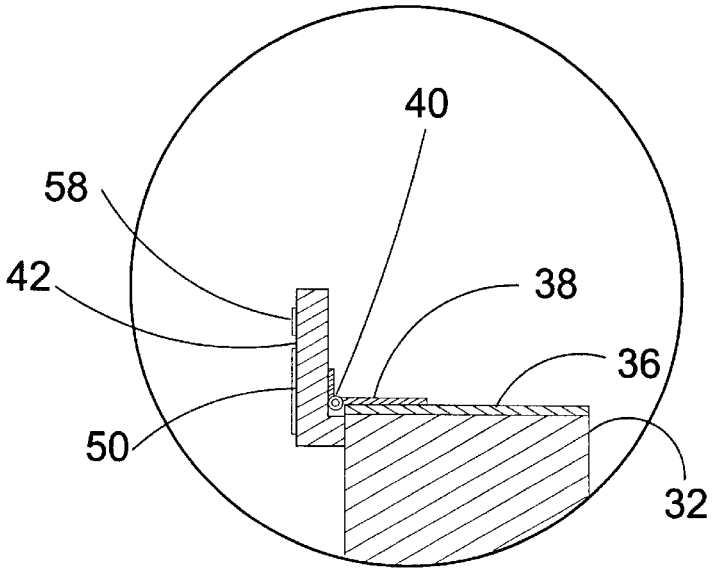

FIG. 9 is a side view of the digital timer of the present invention shown with the lid closed. The digital timer of the present invention is set by pressing the desired key indicating the amount of time the lid will remain open. When the time has expired the lid will be released to close off the candle housing.

Figure 10:
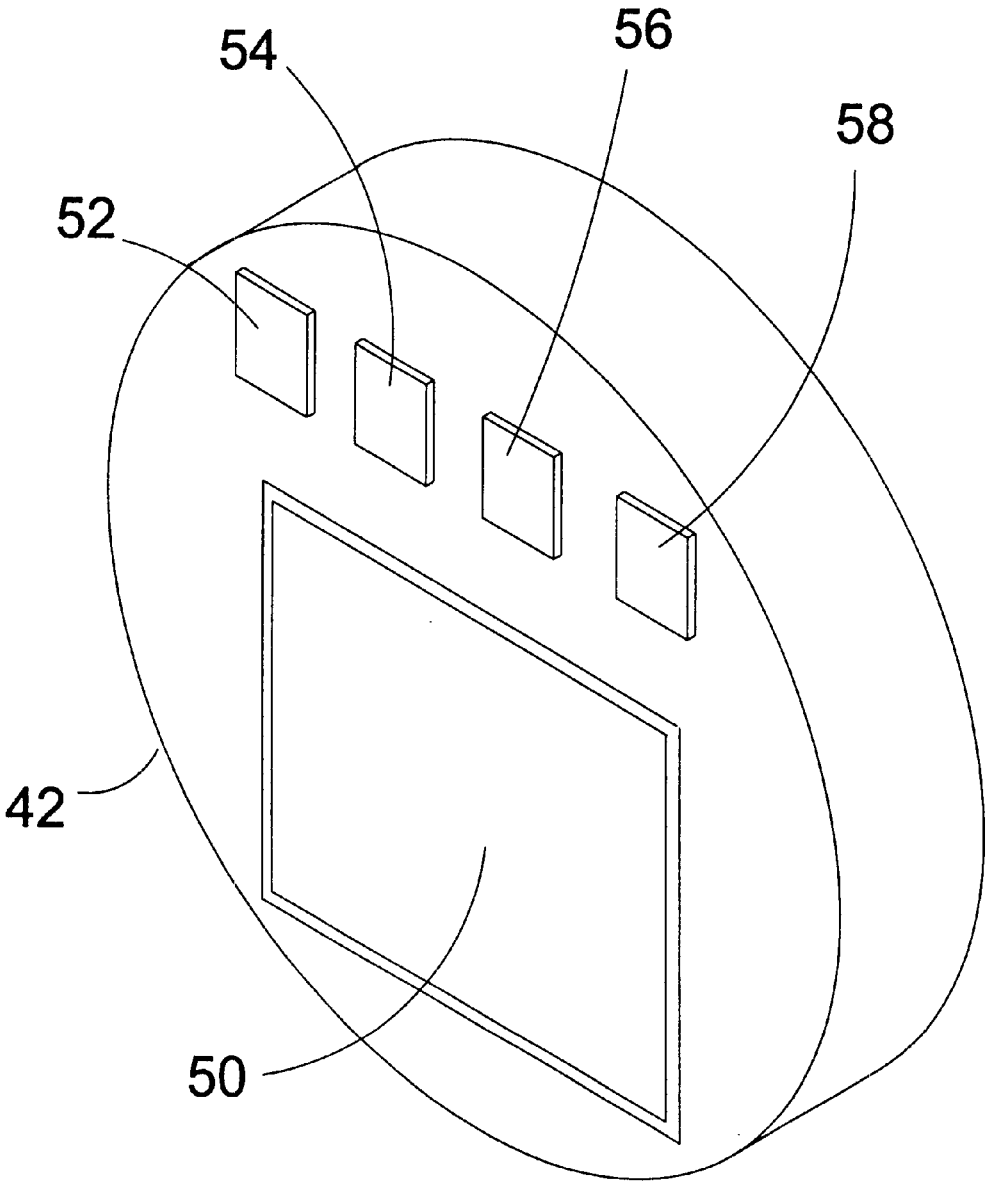

FIG. 10 is a detail view of the timer of the present invention. The digital timer of the present invention is set by pressing the desired key indicating the amount of time the lid is to remain open.

Figure 11:
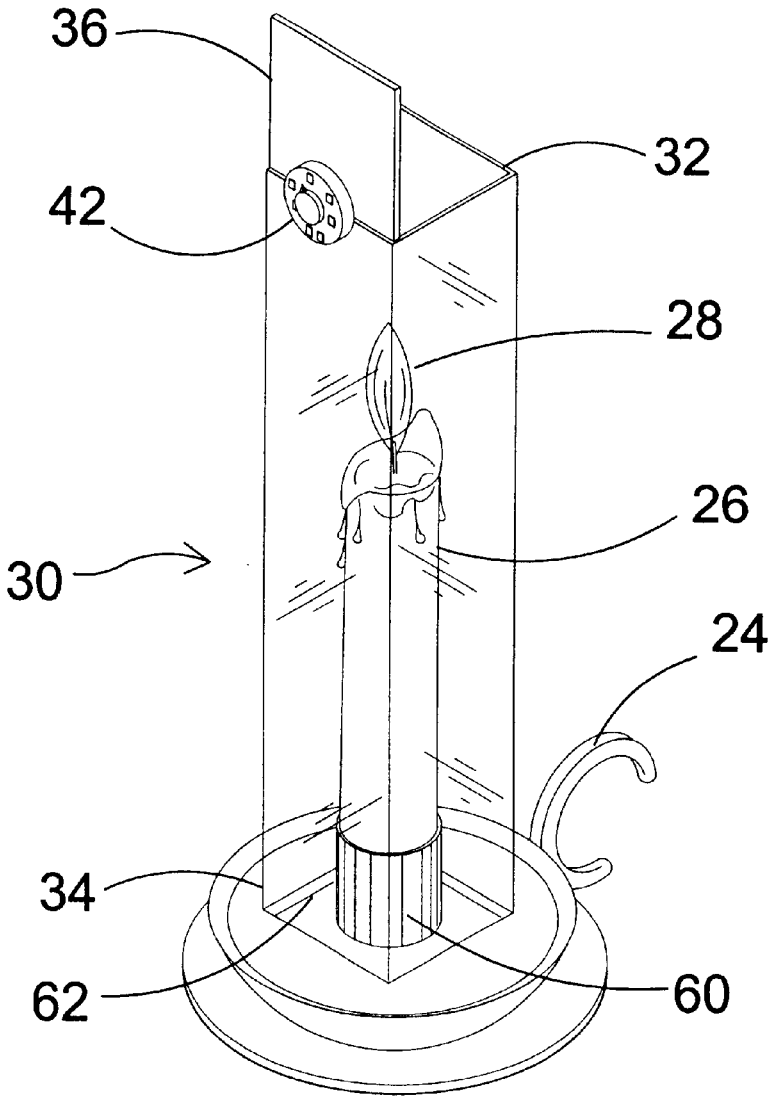

FIG. 11 is an alternate embodiment of the present invention, in which the candle holder is included and housing, is received in a special indentation.

DESCRIPTION OF THE REFERENCED NUMERALS

Turning now descriptively to the drawings, in which similar reference characters denote similar elements throughout the several views, the figures illustrate the Automatic Candle Snuffer of the present invention. With regard to the reference numerals used, the following numbering is used throughout the various drawing figures.

20 Automatic Candle Snuffer of the present invention
22 users
24 prior art candle holder
26 candle
28 candle flame
30 housing

32 housing top end
34 housing bottom end
36 lid
38 hinge lid portion
40 hinge fixed portion
42 timer
50 timer display
52 timer function button
54 timer function button
56 timer function button
58 timer function button
60 candle receiving portion of candle holder
62 indented space

DETAILED DESCRIPTION OF THE PREFERRED EMBODIMENTS

In the following detailed description of the preferred embodiments, reference is made to the accompanying drawings that form a part hereof, and in which are shown by way of illustration specific embodiments in which the invention may be practiced. It is to be understood that other embodiments may be utilized and structural changes may be made without departing from the scope of the present invention. For definition of the complete scope of the invention, the reader is directed to appended claims.

Figure 1:
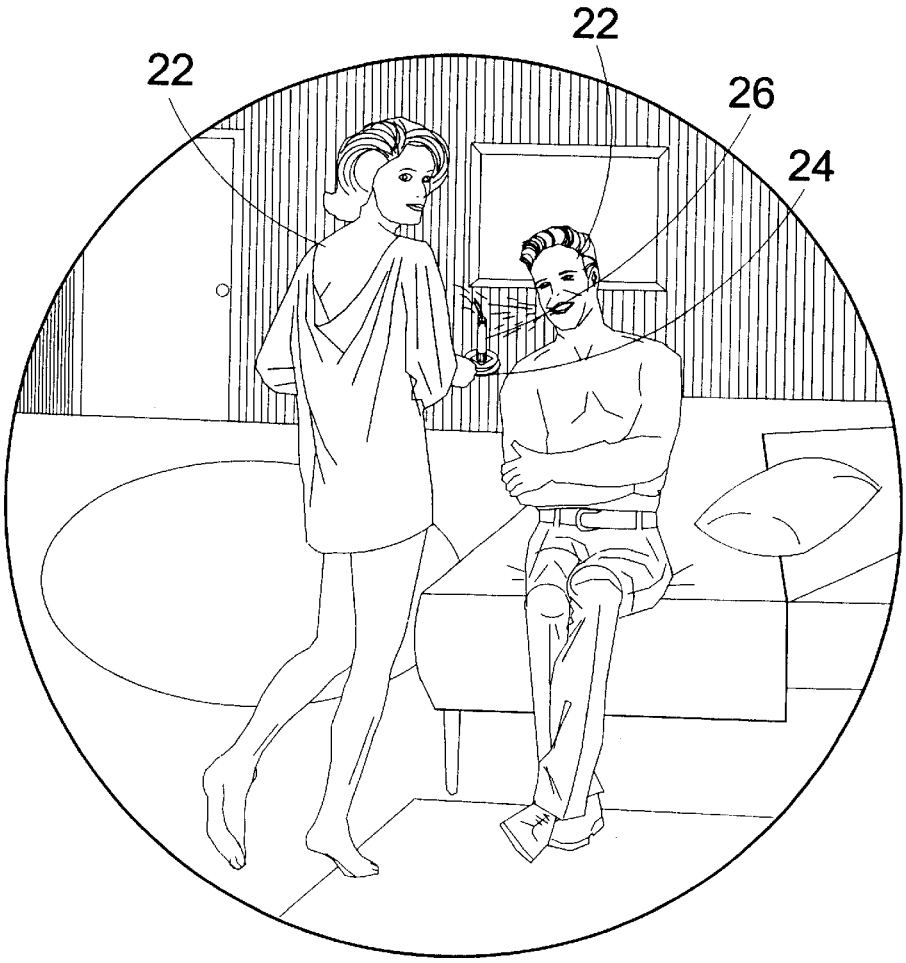
FIG 1 ( PRIOR ART)
Figure 2:
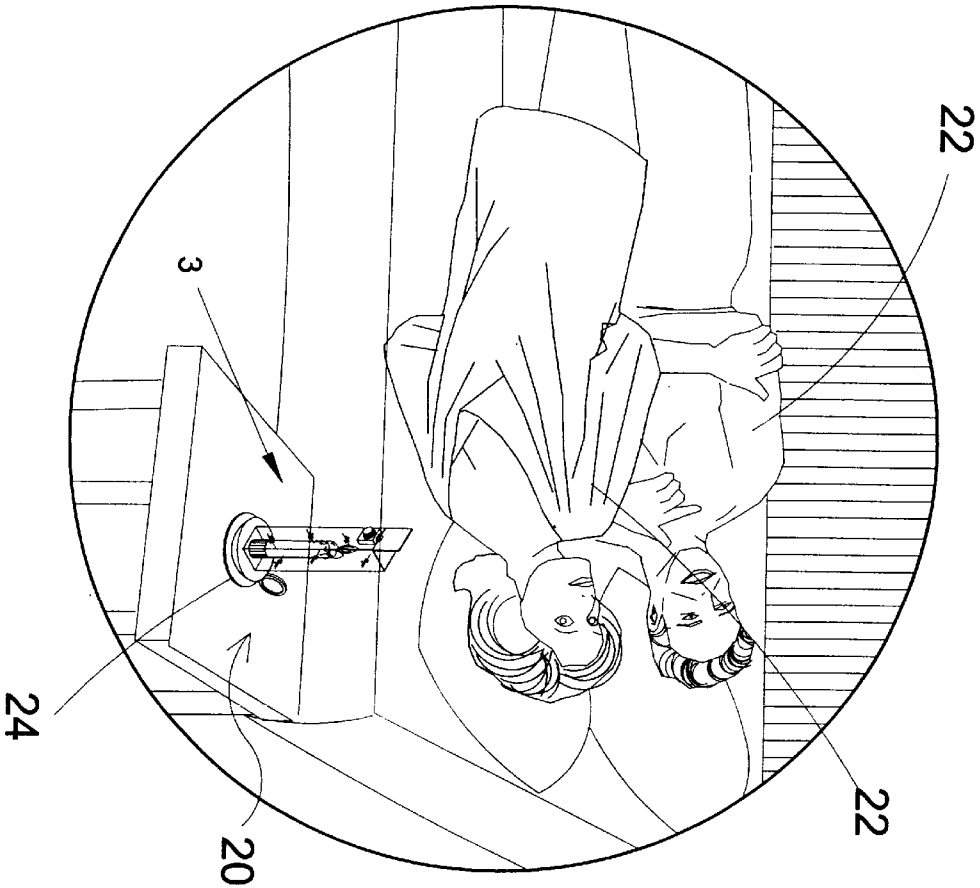

The Automatic Candle Snuffer 20 is shown generally in FIGS. 2–11, and in use by users 22 in FIG. 2. FIG. 1 depicts a prior art candle-candle holder arrangement, in which the user 22 must extinguish the flame 28 by blowing.

Figure 3:
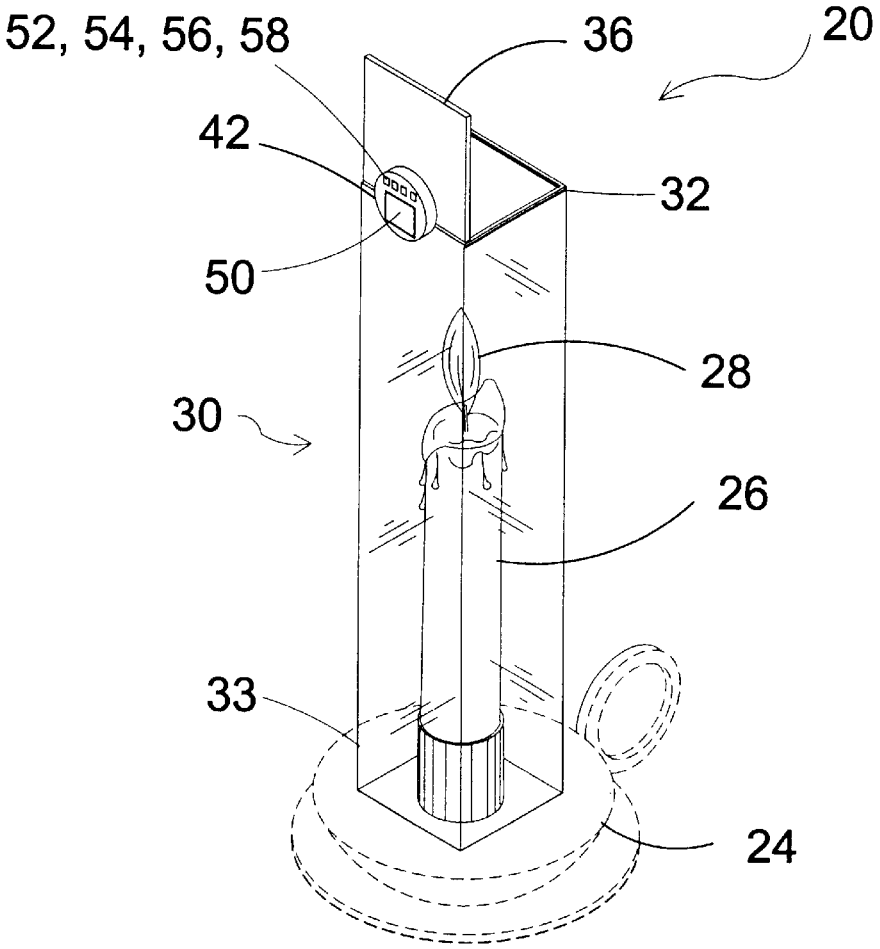

As shown in FIG. 3, the device 20 is supported by a typical candle holder 24, the candle holder 24 holding a candle 26 in the ordinary position wherein the flame 28 is aligned with the longitudinal axis of the candle 26.

The device 20 has a housing 30 that is constructed from heat resistant glass. The housing 30 has an open top end 32 and bottom end 34, although the bottom end 34 flushes or mates with the candle holder 24 such that an insufficient amount of air passes through the bottom end 34 to sustain the flame 28.

Figure 4:
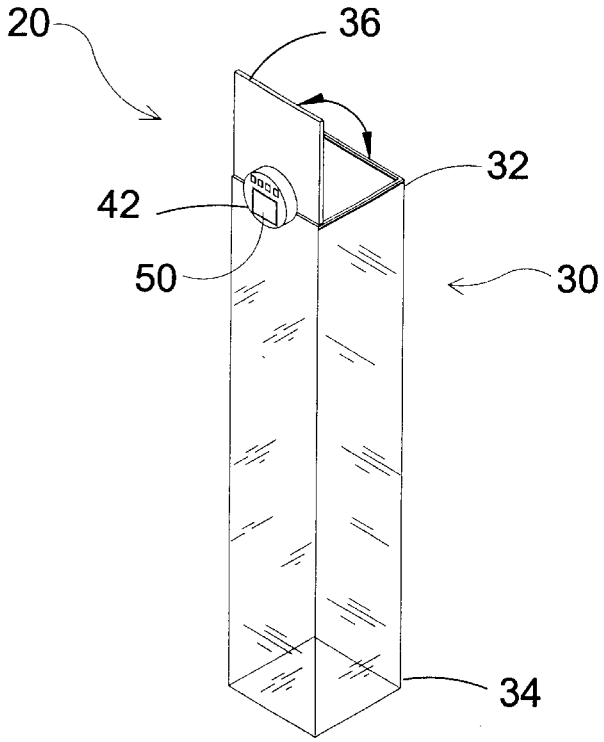
Figure 5:
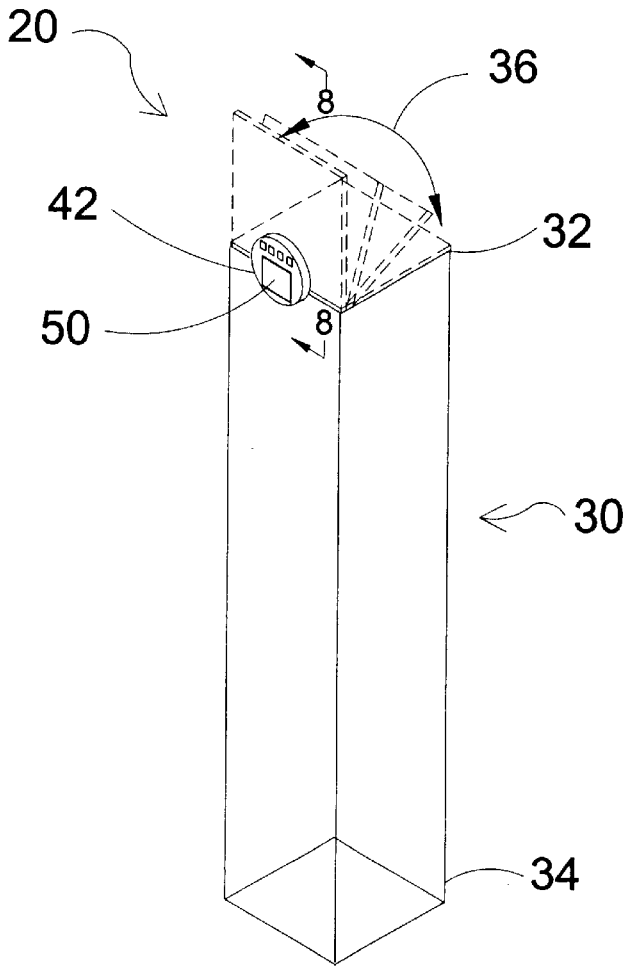
Figure 6:
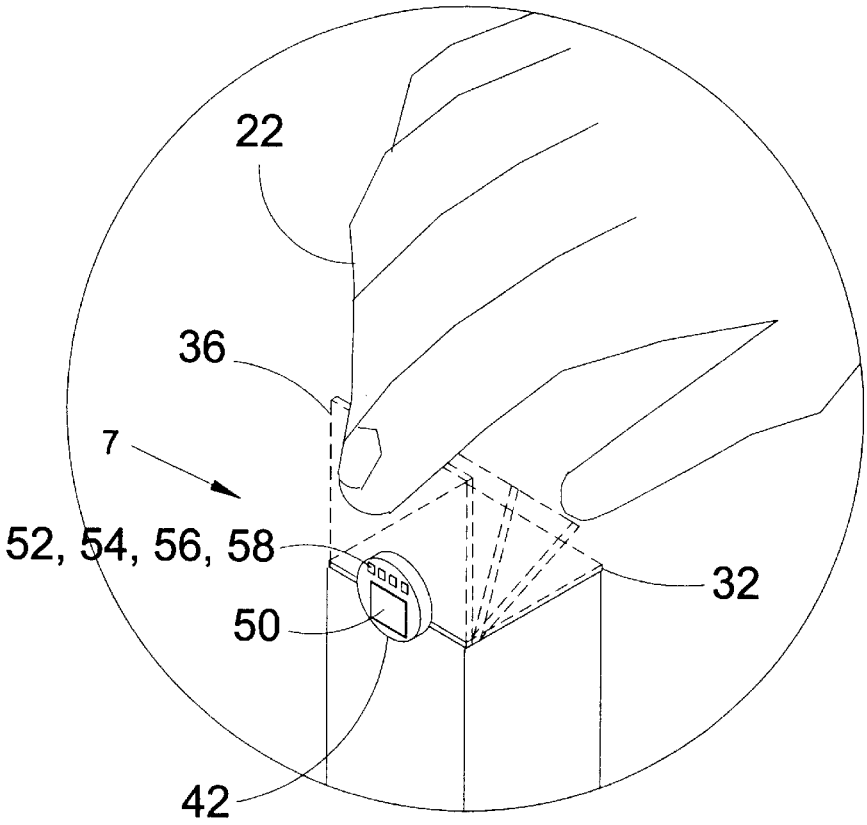
Figure 7:
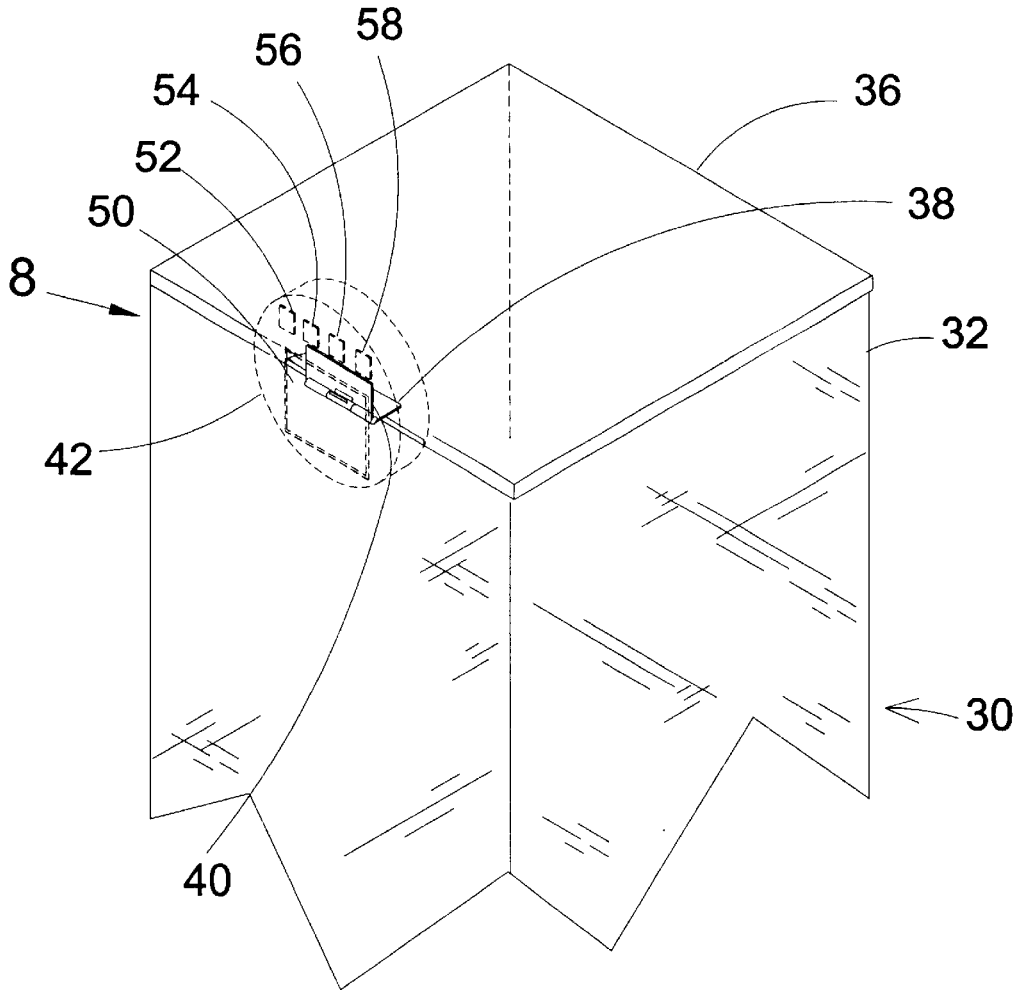
FIG. 7 is a partial view of the device of the present invention shown in a closed position. The digital timer of the present invention is set by pressing the desired key indicating the amount of time the candle is lit, to the time the system will close the lid and snuff out the candle.
Figure 8:
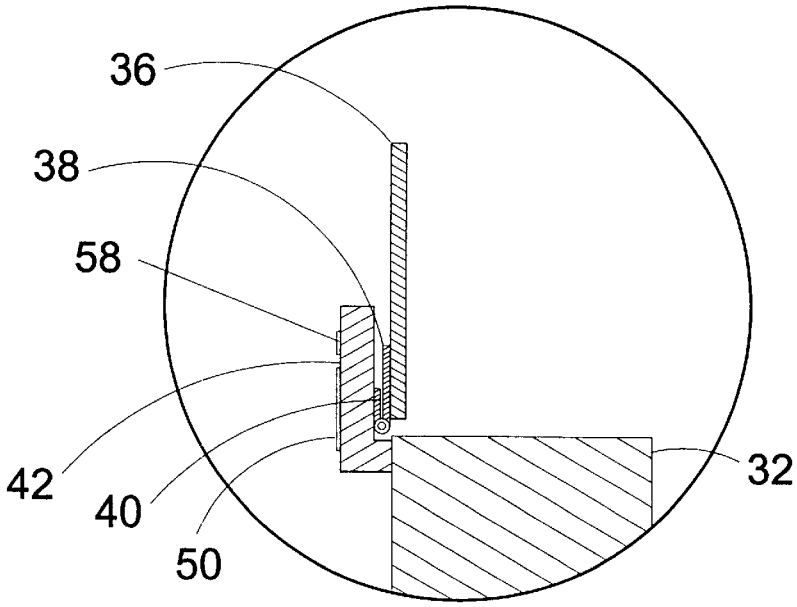
FIG. 8 is a side view of the digital timer of the present invention shown with the lid open.

The device 20 has a lid 36 that is adapted to close in the housing top end 32 when the lid 36 is in a down position, as shown in FIGS. 5, 7 and 9. As shown in FIGS. 5, 6, 8 and 9, the lid 36 is hinged with a hinge lid portion 38 being attached to the lid 36, and a hinge fixed portion 40 being attached to a digital timer 42. The timer 42 is attached to the housing 30, as further shown in FIGS. 8–9. The housing top end 32 is open, that is, the housing top end 32 allows sufficient airflow into the housing 30 to sustain the flame 28, when the lid 36 is in the up position as depicted in FIGS. 3, 4, and 8.

The timer 42 is electrically enabled to magnetize the hinge fixed portion 40 and the hinge lid portion 38 is magnetic, such that the hinge fixed portion 40 and the hinge lid portion 38 are magnetically coupled when the lid 36 in the up position and the timer 42 has magnetized the hinge fixed portion 40. When the timer 42 ceases to magnetize the hinge fixed portion 40, however, the magnetic coupling terminates and gravity causes the lid 36 to hingedly descend into the lid's 36 down position on the housing top end 32. As a result insufficient airflow enters the housing 30 to sustain the candle flame 28.

The user 22 operates the device 20 by viewing the display screen 50 while manipulating the timer function buttons 52,54,56,58 as needed to magnetize the hinge fixed portion 40 and set the timer 42 to terminate such magnetization. As shown on FIG. 10, a preferred arrangement of the timer function buttons 52,54,56,58 includes a SET/SELECT button 52 to initiate the process. When pushed the user 22 can then press the HOUR button 54 to choose the hour, and the MINUTE button 56 to choose the minute. Once properly set the ENTER button 58 is pushed to accept the hour and minute chosen and magnetize the fixed hinge portion 40. As further shown in FIG. 6, the user 22 then lifts the lid 36 to the up position where the lid 36 is magnetically coupled with the magnetized fixed hinge portion 40.

In the preferred embodiment, the display 50 can be selectively set to display the current time, the time at which the candle flame 28 will be snuffed, or the time remaining until the candle flame 28 will be snuffed.

Having successfully initiated the device 20, the user 22 need not be concerned with extinguishing the flame 28. At the time set on the digital timer 42, the timer 42 will demagnetize the fixed hinge portion 40, and gravity will cause the lid 36 to fall to its down position, closing off the housing 30.

One embodiment includes a hinge that is not magnetized. The lid is hinged with a normal hinge, but the lid is magnetic, and the digital timer has a portion that is magnetized to magnetically couple with the lid in the same manner that the fixed hinge portion 40 coupled with the hinge lid portion 38.

In another embodiment, shown in FIG. 11, the housing 30 includes a closed bottom end 34, the housing 30 having the candle 26 receiving portion 60 of the candle holder 24 encompassed within the housing. In such a configuration, the housing bottom end 34 can be freestanding or can be received within an indented space 62 in an included candle holder 24.

The device 20 and its foregoing components can be constructed using various materials, including various metals, woods, and plastics for the housing 30 and lid 36 provided a sufficient amount of insulation and metallic material is used in the lid 36, the hinge fixed portion 40, and/or the hinge lid portion 38. The materials, in various component combinations, can be sized to accommodate candles 26 of various sizes, shapes and orientations, all in accordance with the present invention, and as determined by the intended end use for the overall device 20.

With respect to the above description then, it is to be realized that the optimum material and dimensional relationships for the parts of the device 20, to include variations in size, materials, shape, and form, will occur to those skilled in the art upon review of the present disclosure, and all equivalent relationships to those illustrated in the drawings and described in the specification are intended to be encompassed by the present invention.

What is claimed as new and desired to be protected by Letters Patent is set forth in the appended claims:

1. A device for extinguishing the flame of a candle in a candle holder, comprising:

a housing portion having a top end, a bottom end, a top opening, and a bottom opening, the bottom end being adapted for receipt by the candle holder, such that the housing is supported by the candle holder and air flow through the bottom opening is substantially eliminated;

a timer having a magnetized portion, the timer being programmed and configured such that the timer's magnetized portion is demagnetized at a time set on the timer, the timer being settable for subsequent remagnetization; and a lid, the lid being hinged to the housing, the lid being sized to substantially eliminate airflow into the top opening when the lid is on the top opening, the lid having a magnetic portion, the lid and the timer being positioned such that the timer's magnetized portion is magnetically coupled to the lid's magnetic portion when the lid is open, the lid being further positioned such that the lid is closed by gravity on to the housing top end when the magnetic coupling with the timer is terminated, the air in the housing subsequently being insufficient to sustain the candle flame.

2. The device of claim 1, wherein the timer has push-button controls.

3. The device of claim 1, wherein the timer has a display.

4. The device of claim 3, wherein the display is lighted.

5. The device of claim 1, wherein the timer is digital.

6. The device of claim 1, wherein the display displays the amount of time until the next demagnetization event.

7. The device of claim 1, wherein the display displays the current time.

8. The device of claim 1, wherein the display displays the time of the next demagnetization event.

9. The device of claim 1, wherein the display displays the time.

10. A device for extinguishing the flame of a candle, comprising:

a housing portion having a top end, a closed bottom end, and a top opening, the bottom end being adapted to receive and support the candle;

a timer having a magnetized portion, the timer being programmed and configured such that the timer's magnetized portion is demagnetized at a time set on the timer, the timer being settable for subsequent remagnetization; and a lid, the lid being hinged to the housing, the lid being sized to substantially eliminate airflow into the top opening when the lid is on the top opening, the lid having a magnetic portion, the lid and the timer being positioned such that the timer's magnetized portion is magnetically coupled to the lid's magnetic portion when the lid is open, the lid being further positioned such that the lid is closed by gravity on to the housing top end when the magnetic coupling with the timer is terminated, the air in the housing subsequently being insufficient to sustain the candle flame.

11. The device of claim 10, wherein the bottom end is adapted for supporting receipt by a candle holder.

12. A device for extinguishing the flame of a candle, comprising:

a candle holder;

a housing portion having a top end, a bottom end, a top opening, and a bottom opening, the bottom end being adapted for receipt by the candle holder, such that the housing is supported by the candle holder and air flow through the bottom opening is substantially eliminated;

a timer having a magnetized portion, the timer being programmed and configured such that the timer's magnetized portion is demagnetized at a time set on the timer, the timer being settable for subsequent remagnetization; and a lid, the lid being hinged to the housing, the lid being sized to substantially eliminate airflow into the top opening when the lid is on the top opening, the lid having a magnetic portion, the lid and the timer being positioned such that the timer's magnetized portion is magnetically coupled to the lid's magnetic portion when the lid is open, the lid being further positioned such that the lid is closed by gravity on to the housing top end when the magnetic coupling with the timer is terminated, the air in the housing subsequently being insufficient to sustain the candle flame.

13. A device for extinguishing the flame of a candle in a candle holder, comprising:

means for housing the candle;

means for selectively and alternately magnetizing and demagnetizing a member, said means having means for setting a time certain for demagnetization; and a lid, the lid being pivotable with respect to the housing means, the lid being positioned such that airflow into the housing means is substantially eliminated when the lid is in a down position, the lid having a magnetic portion, the lid being further positioned such that the magnetized member is magnetically coupled to the lid's magnetic portion when the lid is in an up position, the lid being further positioned such that the lid is closed by gravity to the down position when the magnetic coupling is terminated, the air in the housing means subsequently being insufficient to sustain the candle flame.

14. A device for extinguishing the flame of a candle in a candle holder, comprising:

a housing portion having a top end, a bottom end, a top opening, and a bottom opening, the bottom end being adapted for receipt by the candle holder, such that the housing is supported by the candle holder and air flow through the bottom opening is substantially eliminated;

a timer attached to the housing;

a lid and a hinge attaching the lid to the timer;

the hinge having a first portion attached to and magnetized by the timer, the timer being programmed and configured such that the hinge first portion is demagnetized at a time set on the timer, the timer being settable for subsequent remagnetization of the hinge first portion;

the lid being sized to substantially eliminate airflow into the top opening when the lid is on the top opening;

the hinge having a magnetic second portion attached to the lid;

the lid and the timer being positioned such that the hinge first portion is magnetically coupled to the hinge second portion when the lid is open; and the lid being further positioned such that the lid is closed by gravity on to the housing top end when the magnetic coupling between the hinge first portion and the hinge second portion is terminated, the air in the housing subsequently being insufficient to sustain the candle flame.

15. The device of claim 14, wherein the timer has push-button controls.

16. The device of claim 14, wherein the timer has a display.

17. The device of claim 16, wherein the display is lighted.

18. The device of claim 14, wherein the timer is digital.

19. The device of claim 14, wherein the display displays the amount of time until the next demagnetization event.

20. The device of claim 14, wherein the display displays the current time.

21. The device of claim 14, wherein the display displays the time of the next demagnetization event.

22. The device of claim 14, wherein the display displays the time.

23. A device for extinguishing the flame of a candle, comprising:

a housing portion having a top end, a bottom end, and a top opening, the bottom end being adapted to receive and support the candle;

a timer attached to the housing;

a lid and a hinge attaching the lid to the timer;

the hinge having a first portion attached to and magnetized by the timer, the timer being programmed and configured such that the hinge first portion is demagnetized at a time set on the timer, the timer being settable for subsequent remagnetization of the hinge first portion;

the lid being sized to substantially eliminate airflow into the top opening when the lid is on the top opening;

the hinge having a magnetic second portion attached to the lid;

the lid and the timer being positioned such that the hinge first portion is magnetically coupled to the hinge second portion when the lid is open; and the lid being further positioned such that the lid is closed by gravity on to the housing top end when the magnetic coupling between the hinge first portion and the hinge second portion is terminated, the air in the housing subsequently being insufficient to sustain the candle flame.

24. The device of claim 23, wherein the bottom end is adapted for supporting receipt by a candle holder.

25. A device for extinguishing the flame of a candle, comprising:

a candle holder;

a housing portion having a top end, a bottom end, a top opening, and a bottom opening, the bottom end being adapted for receipt by the candle holder, such that the housing is supported by the candle holder and air flow through the bottom opening is substantially eliminated;

a timer attached to the housing;

a lid and a hinge attaching the lid to the timer;

the hinge having a first portion attached to and magnetized by the timer, the timer being programmed and configured such that the hinge first portion is demagnetized at a time set on the timer, the timer being settable for subsequent remagnetization of the hinge first portion;

the lid being sized to substantially eliminate airflow into the top opening when the lid is on the top opening;

the hinge having a magnetic second portion attached to the lid;

the lid and the timer being positioned such that the hinge first portion is magnetically coupled to the hinge second portion when the lid is open; and the lid being further positioned such that the lid is closed by gravity on to the housing top end when the magnetic coupling between the hinge first portion and the hinge second portion is terminated, the air in the housing subsequently being insufficient to sustain the candle flame.

* * * * *